US006688985B2

(12) United States Patent
Weiss et al.

(10) Patent No.: US 6,688,985 B2
(45) Date of Patent: Feb. 10, 2004

(54) ELECTRICALLY CONTROLLED RACING GAME WITH INFORMATION AND CONTROL CENTER

(75) Inventors: Stephen N. Weiss, Philadelphia, PA (US); Gerhart P. Huy, Hamilton Square, NJ (US); Dean C. Reisher, Brick, NJ (US); Joseph T. Moll, Prospect Park, PA (US); Gregory R. Nungester, Berwyn, PA (US); Frank W. Winkler, Mickleton, NJ (US); Justin M. Discoe, Merchantville, NJ (US)

(73) Assignee: Mattel, Inc., El Segundo, CA (US)

( * ) Notice: Subject to any disclaimer, the term of this patent is extended or adjusted under 35 U.S.C. 154(b) by 66 days.

(21) Appl. No.: 10/062,065

(22) Filed: Jan. 31, 2002

(65) Prior Publication Data

US 2002/0147050 A1 Oct. 10, 2002

Related U.S. Application Data

(60) Provisional application No. 60/267,217, filed on Feb. 7, 2001, and provisional application No. 60/290,382, filed on May 11, 2001.

(51) Int. Cl.[7] ..... A63F 9/14

(52) U.S. Cl. ..... 463/58; 463/1; 463/59; 463/60; 273/86 R

(58) Field of Search ..... 463/1–6, 40–42; 273/86 R; 46/1 K, 44; 104/60; 238/10 F

(56) References Cited

U.S. PATENT DOCUMENTS

| | | | | |
|---|---|---|---|---|
| 3,400,667 A | | 9/1968 | Case et al. | |
| 3,467,311 A | * | 9/1969 | Ernst | 463/62 |
| 3,546,696 A | | 12/1970 | Waters et al. | |
| 3,572,711 A | | 3/1971 | Conklin et al. | |
| 3,594,921 A | | 7/1971 | Quicker, Jr. | |
| 3,630,524 A | * | 12/1971 | Cooper et al. | 463/63 |
| 3,652,937 A | | 3/1972 | Garrott | |
| 3,926,434 A | | 12/1975 | Cannon, Jr. | |
| 3,942,114 A | | 3/1976 | Keeling | |
| 3,970,309 A | * | 7/1976 | Sato | 463/59 |
| 4,247,107 A | | 1/1981 | Smith, III et al. | |
| 4,330,127 A | | 5/1982 | Brand et al. | |
| 4,349,196 A | | 9/1982 | Smith, III et al. | |
| 4,570,151 A | | 2/1986 | Martorano et al. | |
| 4,636,782 A | | 1/1987 | Nakamura et al. | |
| 4,649,381 A | | 3/1987 | Masuda et al. | |
| 4,728,104 A | | 3/1988 | Cheng | |
| 4,817,948 A | * | 4/1989 | Simonelli | 463/6 |
| D302,446 S | | 7/1989 | Cheng | |
| D317,026 S | | 5/1991 | Ueyama | |
| 5,218,909 A | | 6/1993 | Ng | |
| 5,330,380 A | | 7/1994 | McDarren et al. | |
| 5,342,048 A | * | 8/1994 | Jones et al. | 463/62 |
| 5,970,882 A | | 10/1999 | Smith et al. | |
| 6,109,186 A | | 8/2000 | Smith et al. | |

FOREIGN PATENT DOCUMENTS

EP 0806230 A1 11/1997

* cited by examiner

*Primary Examiner*—Teresa Walberg
*Assistant Examiner*—Robert Mendoza
(74) *Attorney, Agent, or Firm*—Akin Gump Strauss Hauer & Feld, LLP

(57) ABSTRACT

A system for racing an electrically powered toy vehicle over a defined course under operator control comprises a continuous track having at least one lane with a pit stop segment and an electrical path extending along the lane for providing electrical power to the vehicle. A control unit is operably connected to the electrical path. The control unit has first one control mechanism that can be manipulated by an operator to vary a speed of the electrical vehicle and another to perform at least one pit stop function such as a tire change or a vehicle refueling. A display is operably connected to the control unit for visually displaying a progression of the pit stop function in response to manipulation of the other control mechanism.

25 Claims, 17 Drawing Sheets

21
126
116
114
118
112
120
110
122
130
132
38
39
37
26
24
56
13
98
108
18
20
55
134
124
45
43
47
32
30

ELECTRICALLY CONTROLLED RACING GAME WITH INFORMATION AND CONTROL CENTER

RELATED APPLICATIONS

This application claims the benefit of U.S. Provisional Patent Application No. 60/267,217 filed Feb. 7, 2001 and No. 60/290,382 filed May 11, 2001.

BACKGROUND OF THE INVENTION

This invention relates to toys, and more particularly to an information and control center for a toy racing system with electrically controlled vehicles that run on electrically powered tracks.

Toy racing systems of the slot, slotless, and steerable type have grown in popularity over the years. The vehicles of such systems come in a variety of sizes and styles, but each typically includes an electric motor for driving the vehicles around the track. The tracks of such systems can range from a simple oval comprising a single lane with an electrical path extending along the lane for providing electrical power to the vehicle, to multiple lanes and electrical paths disposed through an assortment of curves and loops to provide a challenging environment to those of more advanced operating skills, and thus more enjoyment during operation of the toy racing system.

In an effort to more realistically portray actual racing conditions, U.S. Pat. No. 4,247,107 issued to Smith, III et al. has proposed an electronically controlled road race system with facilities for starting a race, counting and displaying completed laps for each car, calculating and displaying remaining fuel for each car, introducing random failures for each car, and a track section that is decoupled from track power for the performance of pit functions. In order to refuel a car during a pit stop, a pit switch must be continuously actuated for nine seconds before the car is fully refueled. For repairs of different failure conditions, the pit switch must be actuated for predetermined time periods depending on the type, and thus the severity of the failure. Although this system provides a more realistic approach to actual racing events, there is no provision for interactive control and feedback of the pit stop functions where the length of time in the pit stop is dependent on the operator's skill.

BRIEF SUMMARY OF THE INVENTION

The invention is used in a system including an electrically powered toy vehicle and a continuous loop track for racing the electrically powered toy vehicle under operator control, the continuous track having at least one lane and an electrical path extending along the lane for providing electrical power to the vehicle about the track. The invention is a combination that comprises a pit stop segment in at least one lane. It further comprises a control unit operably connected with the electrical path. The control unit includes a control mechanism manually operable to electronically perform at least one simulated pit stop function on an electrically powered toy vehicle while in the pit stop segment. The combination further comprises an electrically operated display unit operably connected to the control unit and is configured to generate a visual display of a progression of the at least one simulated pit stop function in response to manipulation of the second control mechanism.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

Figure 1:
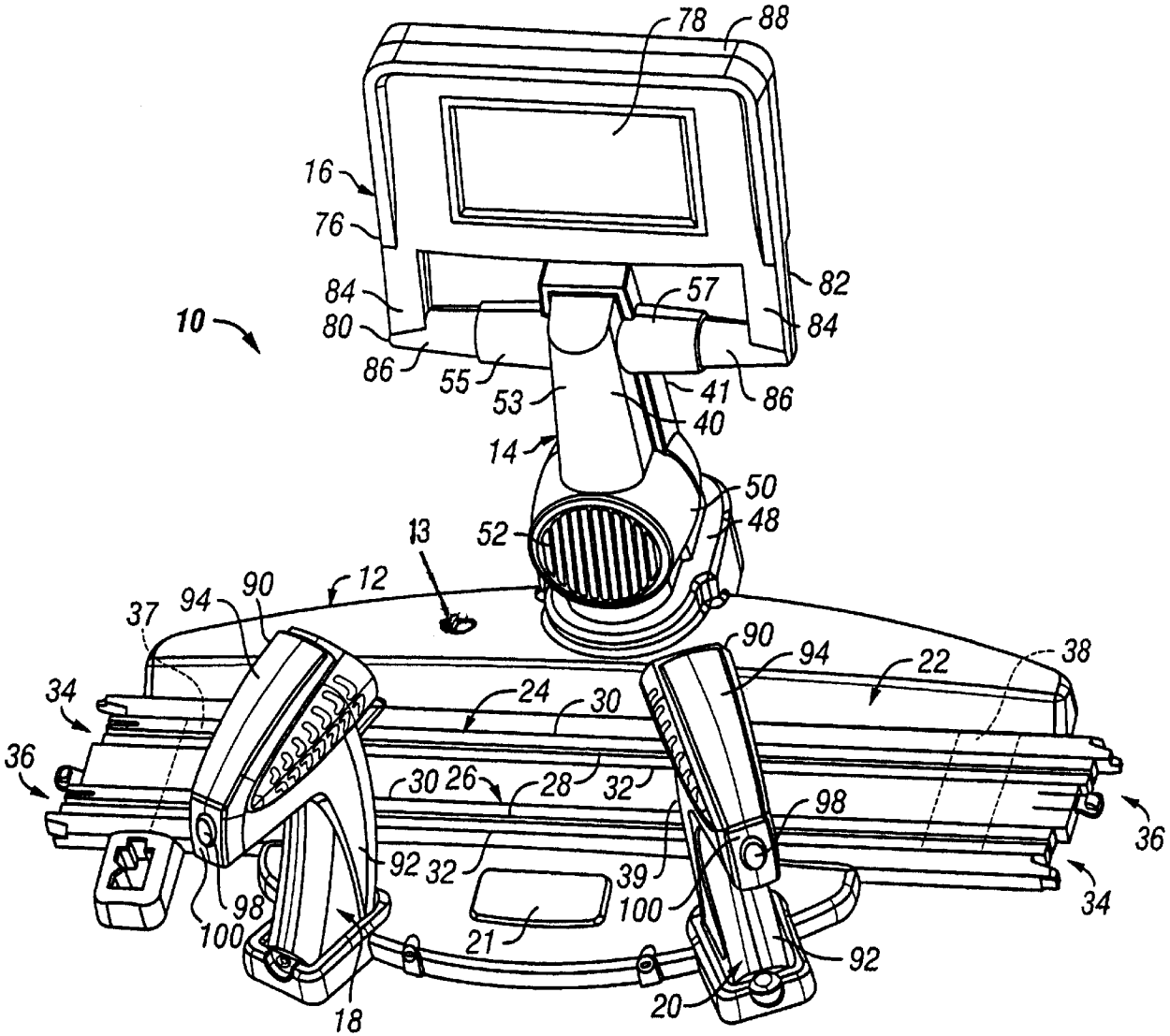
FIG. 1 is a front perspective view of an information and control center according to the invention.

It is noted that the drawings are intended to represent only typical embodiments of the invention and therefore should not be construed as limiting the scope thereof. The invention will now be described in greater detail with reference to the drawings, wherein like parts throughout the drawing figures are represented by like numerals.

DETAILED DESCRIPTION OF THE INVENTION

Figure 2:
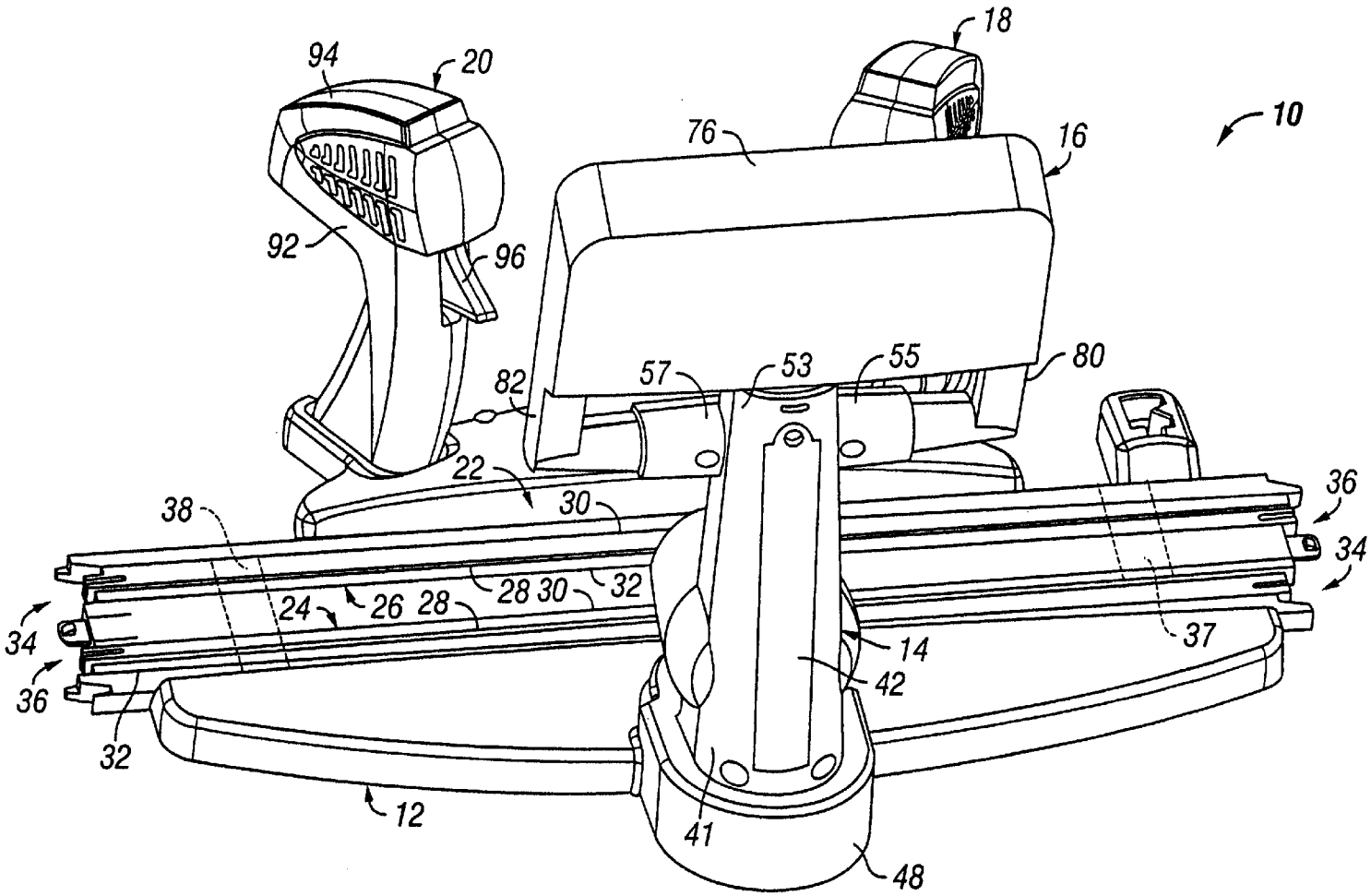
FIG. 2 is a rear perspective view of the information and control center of FIG. 1.

Referring now to the drawings, and to FIGS. 1 and 2 in particular, an information and control center 10 according to the present invention for use with electrically-powered vehicles is illustrated. The center 10 is used with an otherwise conventional continuous loop track and one or more electrically powered toy vehicles, neither depicted. Such tracks include at least one lane and an electrical path extending along the lane for providing electrical power to at least one of the toy vehicles about the track. As shown, the center 10 includes a base member 12, a tower 14 extending generally upwardly from the base member, an electrically operated display unit or simply "display" 16 pivotally connected to an upper end of the tower, and a pair of hand control units 18, 20 that are removably mounted on the base member 12.

The base member 12 includes an on-off button 13 and a selector button 21 for turning the system on, selecting different game options viewed on the display 16, and for resetting the information and control center 10, as will be described in greater detail below. An elongate channel 22 is formed in the base member 12 and two sets of tracks 24, 26 extend along a bottom of the channel. Each track 24, 26 may include a slot 28 with a conductive rail 30, 32 on either side of the slot. The slot 28 would be adapted to receive a guide pin (not shown) from an electrically-powered vehicle (not shown), while the conductive rails are engageable with corresponding contacts on the vehicle for driving a motor, lights, and so on in the vehicle, in a well-known manner. A combination electrical/mechanical connector 34, 36 is located at opposite ends of each track 24, 26 for electrically and mechanically coupling with other track segments (not shown) and into the continuous loop track. The base member 12 together with the other track segments are preferably arranged in a continuous loop so that the vehicles can complete several laps. A pair of isolation areas 37 and 38 (represented by dashed lines in FIG. 1) are preferably formed by two pairs of breaks 43 (FIG. 4) in each of the conductive rails 32 to form an isolated conductive rail segment 45. A pit stop area 39 is defined between the isolation areas 37 and 38 of each track 24 and 26. Two jumper wires 47 connect the ends of each conductive rail 32 around the breaks 43 so that power may be selectively supplied to and cut off from each set of tracks 24, 26 in the continuous loop of track segments, as will be described in greater detail below.

Figure 3:
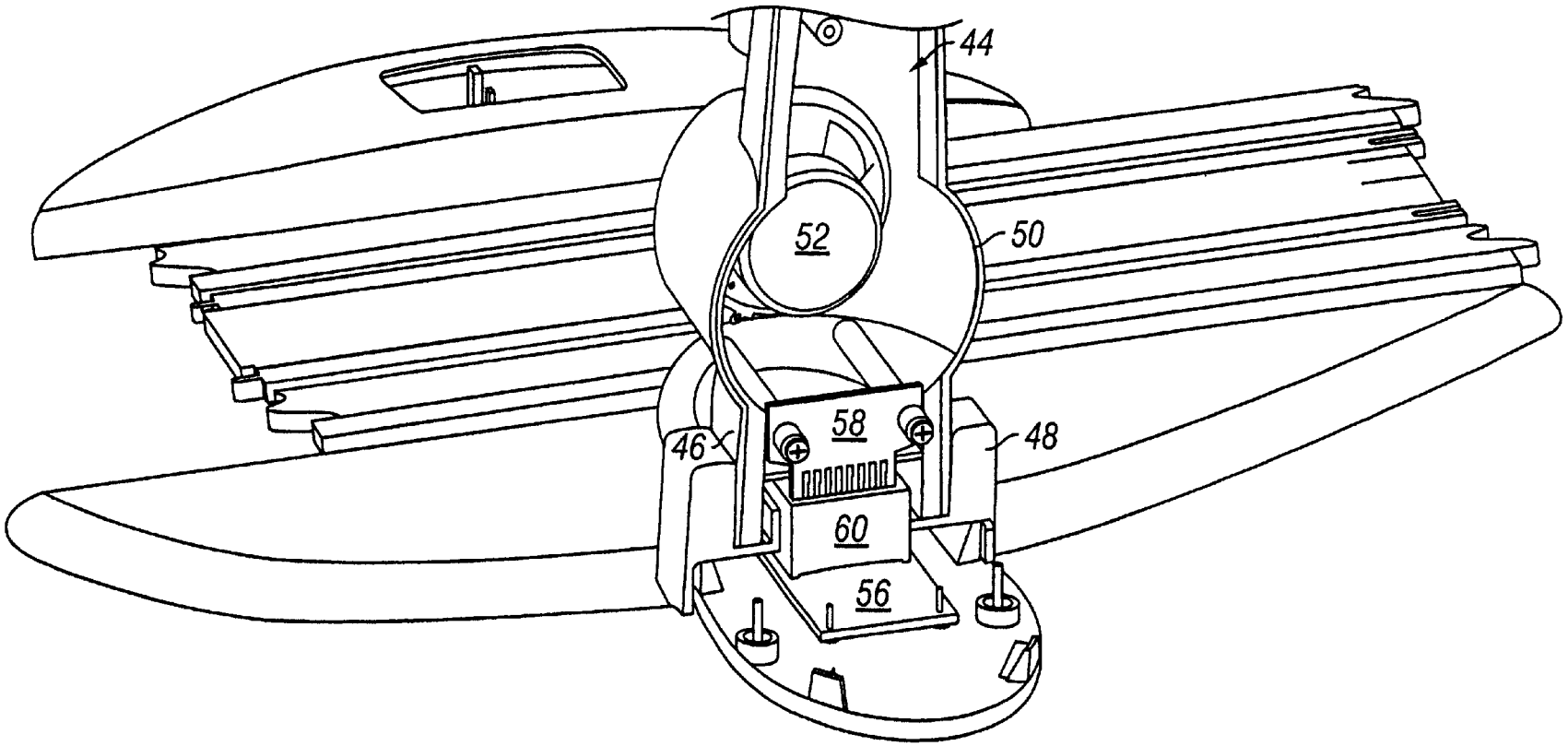
FIG. 3 is an enlarged rear perspective view of a lower tower portion that forms part of the information and control center.

The tower 14 includes a front wall 40 (FIG. 1), a rear wall 41, and a rear cover 42 that connects to the rear wall (FIG. 2). The front wall 40, rear wall 41, and rear cover 42 form a hollow interior 44 (FIG. 3). A lower end 46 of the tower 14 fits within a mounting flange 48 formed in the base member 12. The tower 14 is removably yet securely connected to the base member 12 by fit but may be more permanently secured through fasteners (e.g., screws), adhesive bonding, ultrasonic welding, or other well-known fastening means.

A generally cylindrical speaker housing 50 is formed at the lower end 46 of the tower 14 and contains a speaker 52, preferably of the paper cone type. A battery power supply 51 (FIG. 5) is located in the hollow interior 44 of the tower 14 above the speaker 52 and can be accessed by removing the rear cover 42. An upper end 53 of the tower 14 includes opposing, hollow support arms 55, 57 that extend in a generally horizontal direction for pivotally supporting the display 16, as will be described in further detail below.

The two hand control units 18, 20, the control button 21, the two sets of tracks 24, 26, and the isolation areas 37, 38 are all operably (at least electrically) connected to a control system including a microcontroller 54 (FIG. 5) or other processor through a circuit board 56 (FIG. 4) mounted in the base member 12 and a connector card 58 (FIG. 3) mounted in the lower end 46 of the tower below the speaker housing 50. As shown, the connector card 58 plugs into the circuit board 56 through a generally vertically oriented plug module 60 mounted on the circuit board. The display 16 and the speaker 52 are also coupled to the microcontroller 54. The microcontroller 54 (FIG. 5) is preferably a 4-bit microcontroller operating at 4 Mhz, and includes 256 kb ROM with sound storage and compression features, 16 kb SRAM, a LCD driver, and various input, output, and I/O ports.

Preferably, the microcontroller 54 is located in the display 16 on a controller board 62 (FIG. 5), but may be positioned at any desired location in the center 10, such as in the tower 14 or base member 12. When positioned in the display 16, a connector cable 64 (FIG. 5) extends from the controller board 62 to the connector card 58. The microcontroller 54, display 16, and speaker 52 are preferably powered by the battery power supply 51 located in the tower 14. Alternatively a wall transformer 75 (FIG. 4) for supplying electrical power to the tracks 24, 26 may supply power to the display, speaker, and the microcontroller with suitable rectifier circuitry.

The display 16 includes a housing 76 that encloses a display panel 78. Preferably, the display panel 78 is a LCD panel, but may alternatively be in the form of a dot-matrix panel, an LED panel, a CRT, and so on. A pair of spaced L-shaped arms 80, 82 are integrally formed with the housing 76. Each arm includes a first arm portion 84 that extends generally downwardly and a second arm portion 86 that extends generally horizontally toward the tower 14. The second arm portions are pivotally received in the opposing, hollow support arms 55, 57. In this manner, the position of the display 16 can be adjusted by tilting the display about the support arms to a desired viewing position. The hollow support arms and second arm portions are preferably dimensioned so that frictional contact between the support arms and second arm portions normally keeps the display in the adjusted position. A visor 88 is formed on the housing 76 for shading the display panel 78 against direct light.

Each hand control unit 18, 20 includes a generally inverted L-shape housing 90 with a handle portion 92 that can be grasped and held by a user and a head portion 94 that extends generally transverse to the handle portion. One manually operable control mechanism of each unit 18, 20 includes a trigger 96 extending out of the housing at an intersection of the handle portion 92 and the head portion 94. The trigger 96 is manually operable to move a wiper arm (not shown) against a resistance strip of a variable resistor 108 (FIG. 4) when depressed to thereby vary the voltage across the variable resistor 108 and control the velocity of a vehicle on its associated track. Another manually operable control mechanism includes a control button 98, which is located at a rear end 100 of each head portion 94. Each control button 98 constitutes the button portion of a push-button momentary contact switch, which is connected to a separate port of the microcontroller 54. Button 98 is manually operable to supply a logical high signal to the microcontroller 54 when depressed. The control button 98 is suggestedly only used to perform certain simulated required maintenance activities (i.e., pit stop functions) on the vehicles during the race as will be explained. The hand control units 18, 20 are preferably hard-wired to the circuit board 56 (FIG. 4), but may alternatively communicate with the microcontroller 54 through infrared, radio wave, or other well-known wireless communication means. If desired, however, control buttons 98 could be used to select desired game options through a set of visual displays on the display panel 78.

Figure 4:
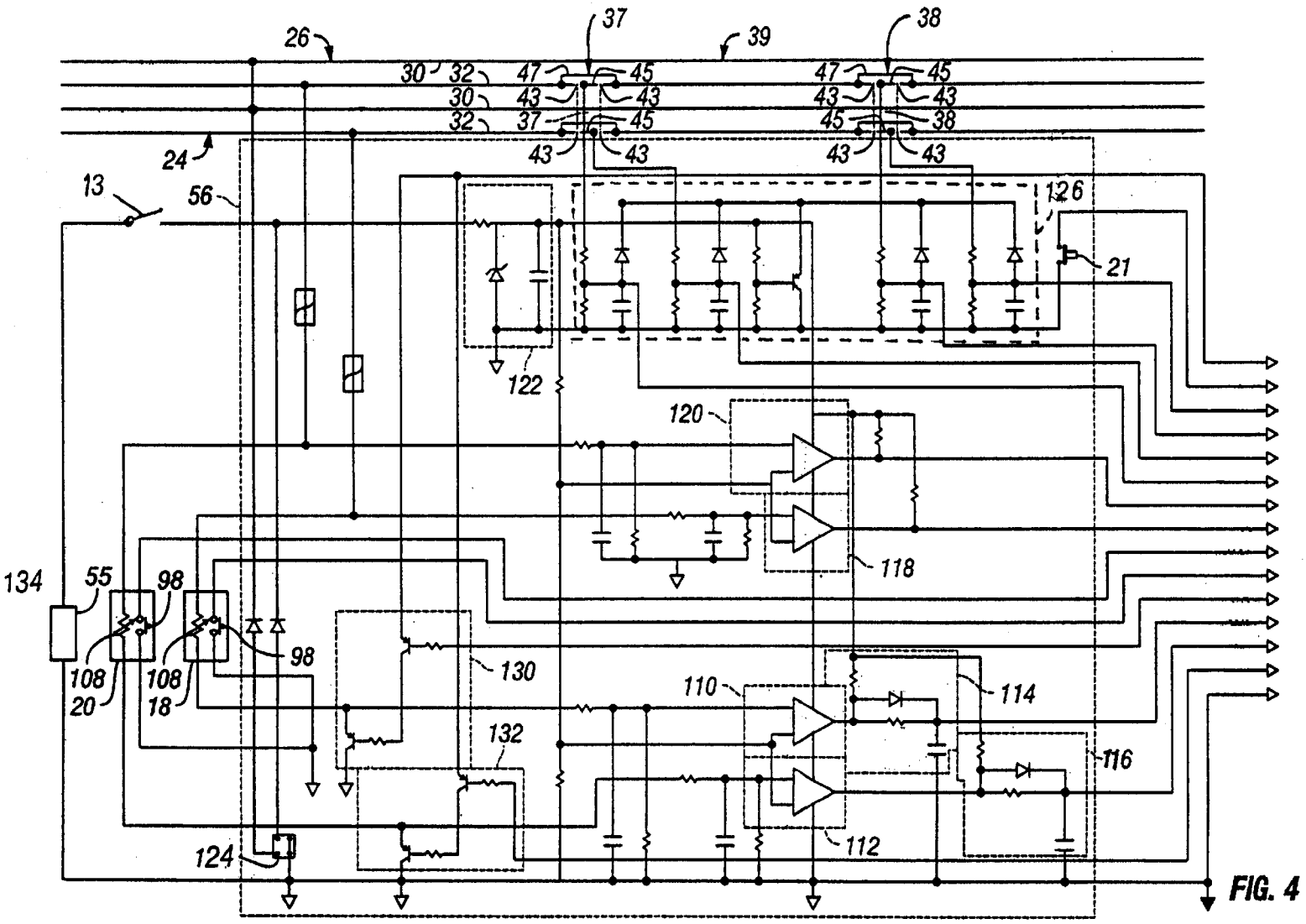
FIG. 4 is a schematic diagram of a first electronic circuit according to the invention for operating the information and control center.
Figure 5:
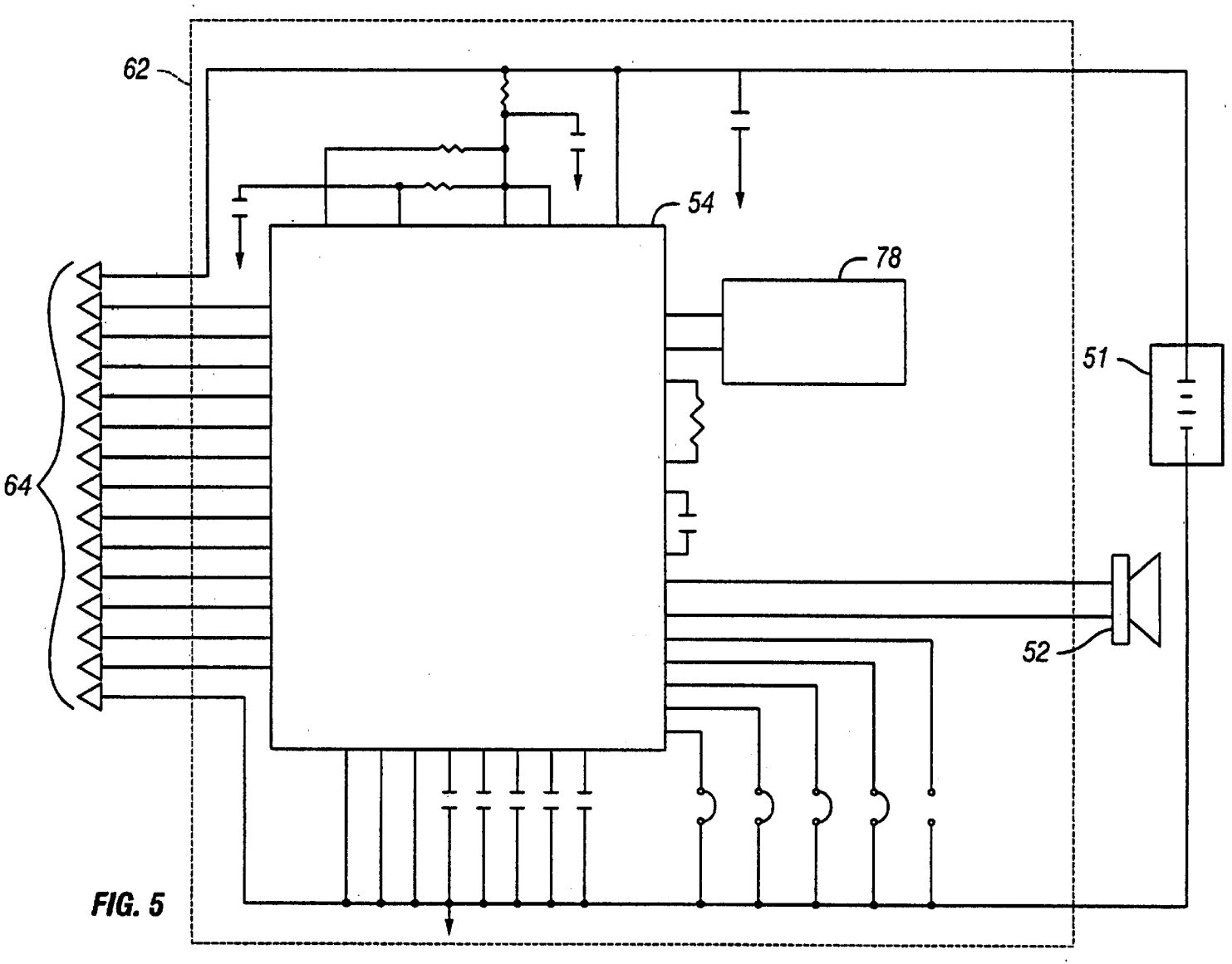
FIG. 5 is a schematic diagram of a second electronic circuit according to the invention for operating the information and control center.

Turning now to FIGS. 4 and 5, electronic circuitry for the information and control center 10 including the control system is illustrated. As shown in FIG. 4, conductive rails 30 of the track 24 (designated as "LANE #1") and the track 26 (designated as "LANE #2") are connected to one side of a transformer power supply 134, while the conductive rails 32 of the tracks 24 and 26 are connected to the other side of the supply 134 through one side of the trigger-actuated variable resistors 108 of the hand control units 18 and 20, respectively. A comparator circuit 110, 112 is connected to each of the variable resistors 108 of the hand control units 18 and 20, respectively, for determining if the trigger 96 in one or both units 18, 20 is being actuated. According to an exemplary embodiment of the invention, it is determined that the trigger 96 is actuated when a voltage across the variable resistor 108 in the hand control unit 18, 20 is greater than 0.2 Volts. The comparator circuit then sends a logic "1 " to the appropriate port of the microcontroller 54 (FIG. 4) through a delay circuit 114 or 116. When the voltage across the hand control unit is less than or equal to 0.2 Volts, the comparator circuit sends a logic "0" to the appropriate port, indicating that the trigger is not being pulled.

A comparator circuit 118, 120 is also connected to each of the variable resistors 108 of the hand control units 18 and 20, respectively, for determining if a vehicle is present on one or both tracks 24, 26. According to an exemplary embodiment of the invention, it is determined that the vehicle is properly positioned on the track when a voltage measured across the tracks, and thus across the vehicle, is greater than 0.2 Volts. Each comparator circuit 118, 120 then sends a logic "1" to the appropriate port of the microcontroller 54 (FIG. 4). When the voltage across the track, and thus the vehicle, is less than or equal to 0.2 Volts, the comparator circuit sends a logic "0" to the appropriate port, indicating that the vehicle is not properly seated on the track.

Each delay circuit 114, 116 is used to keep the voltage high for a predetermined time period so that, once the microcontroller 54 determines that a vehicle is not properly seated on the track, the microcontroller 54 also has time to determine if the associated trigger 96 is being pressed. Preferably, the predetermined time period is approximately 0.3 second longer than the track compare time. If it has been determined that the vehicle is improperly seated and that the trigger 96 is pressed, the microcontroller 54 will conclude that the vehicle has left the track and crashed. The microcontroller 54 can then access an appropriate sound file in memory and send it to the speaker output to thereby audibly indicate that a crash has occurred. An appropriate animation file can also be accessed and sent to the display panel 78, to thereby visually indicate that a crash has occurred.

A circuit 122 receives AC power from the transformer power supply 134 and rectifies it through a resistor, Zener diode, and capacitor arrangement. The rectified power is used to drive the comparator circuits 110, 112, 118, and 120. Although not shown, the rectified power may also be used to drive the microcontroller 134 and other related components and circuitry, in place of the battery power supply 51 as previously described.

The positive side of the wall transformer 134 is connected to the conductive rails 30 of the tracks 24 and 26, as well as the variable resistors 108 of the hand control units 18 and 20, respectively. The conductive rails 30 are also connected to a DPDT switch 124 so that a user can select between playing with or without the functions associate with the information and control center 10.

A first solid state switch 130 is operated by the microcontroller 54 for supplying power to or cutting power from the track 24. Likewise, a second solid state switch 132 is operated by the microcontroller 54 for supplying power to or cutting power from the track 26, in response to logical signals from the tracks 24, 26 and hand control units 18, 20.

The isolated conductive rail segments 45 of the isolated areas 37 and 38 for both tracks 24 and 26 are also connected to the microcontroller 54 through signal conditioning circuitry 126 as shown. Preferably, each rail segment 45 is associated with a separate port of the microcontroller 54. A logical "1 " is sent to the appropriate port of the microcontroller 54 when a car with its contacts passes over one of the isolated rail segments 45 to thereby connect the conductive rail 30 with the isolated rail 45 of each track 24, 26. The logical "1" represents that the vehicle has passed a particular isolation area. If, for example, the track 26 of the isolation area 37 registers a logical "1", it is determined that the vehicle has passed over the isolation area 37 of the track 26. According to an exemplary embodiment of the invention, the isolation areas 37 and 38 are each approximately one inch in length. Under normal operating conditions, the momentum of the vehicle will carry it over the isolation area and back onto the conductive rail 32. Preferably, the isolation area 37 is used to determine the number of laps that each vehicle has traveled, and also signals entrance of the vehicle into the pit stop area 39. The isolation area 38 signals departure of the vehicle from the pit stop.

In order to determine if the vehicle has stopped in the pit stop area 39, a timer is started when the vehicle passes the isolation area 37. If the vehicle fails to pass the isolation area 38 within a predetermined time period, it is determined that the vehicle is located in the pit stop area. Power is then cut from the track that the vehicle is on, until the appropriate pit stop functions are completed.

The microcontroller 54 is programmed to keep track of the number of laps completed, the amount of time taken to complete the laps, the amount of "fuel" that has been used by each vehicle, and the "tire wear" by each vehicle. The amount of fuel used and the tire wear are preferably based on a predetermined number of laps. In addition, power to the tracks is cut off until a vehicle is sensed to be on each track to thereby prevent starting a race. Alternatively, a race may start when it is determined that at least one vehicle is properly located on the track.

Players must stop their vehicles in the pit stop area 39 between the isolation areas to "refuel" and "change tires" when the visual display indicates they are low on fuel or rubber. The microcontroller 54 cuts off power to a player's track if the player does not pit before running out of fuel or rubber. Players simulate refuel and re-tire pit stop functions by repeatedly manipulating (e.g. pressing) the control button 98 on their hand control units while their vehicle is in the pit stop area 39. The visual displays are updated by the microcontroller 54 to indicate fuel intake and tire changes. The vehicles must be fully refueled or retired before the microcontroller 54 will provide power for them to leave the pit stop area 39. During the last lap before a required pit stop, power to the track can be pulsed at a 50% duty cycle to simulate a vehicle running out of fuel or a vehicle with bad tires. Preferably, the pulsed power to the track is on for one second and off for one second so that "car trouble" can be clearly noticed by a player.

Appropriate sound effects for both players are generated by the microcontroller 54. These include countdown beeps that go with a countdown display to begin a race; various engine sounds including motor idle during countdown and pit periods, peel-out when leaving the pit stop area after fueling or re-tiring, high speed sound while racing, crowd cheering at the end of a race, crash sounds, Doppler effect sounds as the vehicles pass through the pit stop area, and so on. A number of visual effects are generated on the display panel 78 including front and side animated views of the vehicles, a starting flag, a finishing flag, vehicle refueling, vehicle being re-tired, vehicle crashing, and so on, as will be described in greater detail below. If desired, separate micro-controllers or other processing means, display panels and speakers can be provided for each player.

Figure 6:
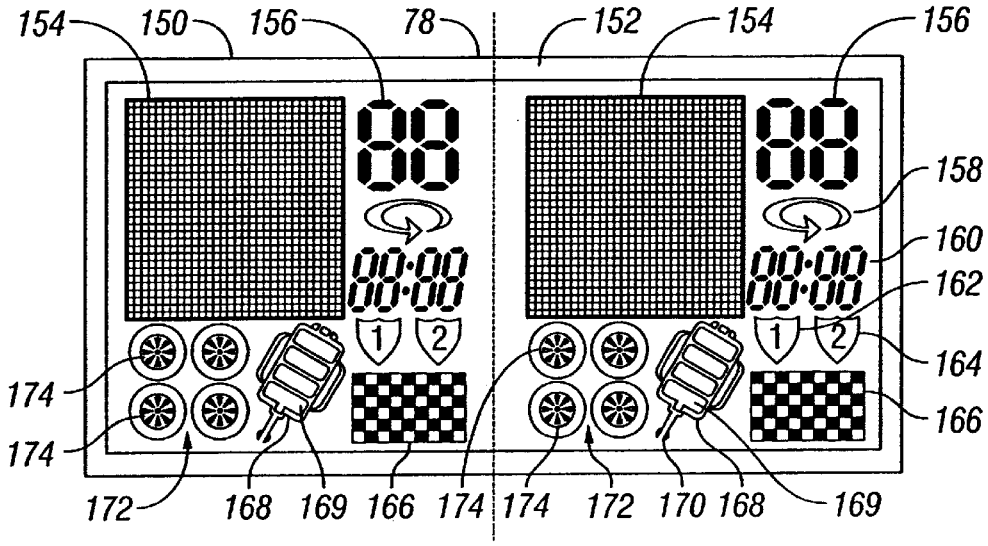
FIG. 6 shows a display panel that forms part of the information and control center.

With reference now to FIG. 6, the display panel 78, preferably in the form of a LCD panel, is electronically divided into two identical sections 150 and 152. Each section 150, 152 is associated with a different vehicle and thus a different user. Since each section is identical, only the section 152 will be described. The section 152 includes several individual displays including a dot matrix display 154, preferably in the form of a 30×30 dot matrix display.

Two digit registers constitute a lap counter visual display 156 used to display the total number of laps during a race, and should begin at '00' and sequence through '01' . . . '02' . . . '03' etc. When the player has reached his last lap, both registers of the counter 156 preferably flash on and off at a 70% duty-cycle to signal the last lap. For a 100-lap race, the '00' is preferably displayed in the absence of the '1' in 100 to reduce cost and conserve image space.

A lap indicator segment visual display 158 in the form of an elliptical arrow, preferably flashes at a 70% duty-cycle to signal that a race is in progress. The lap indicator segment 158 preferably begins flashing when the race begins and then stays illuminated after the race ends.

Four registers constitute a timer visual display 160 used to display the amount of time taken to finish a race. During the 'best race' visual display sequence, the timer 160 is preferably linked with the dot matrix display 154 and cycles through the top three race times for a preselected number of laps. If a new high score is achieved, the timer 160 will preferably flash with the lap indicator segment 158 at a 50% duty-cycle.

A first place visual display icon 162 is used to show first place position in the race. This segment 162 is preferably illuminated when the player is leading the race. At the finish of a race, this segment preferably flashes at a 50% duty-cycle.

A second place visual display icon 164 is used to show second place position in the race. This icon 164 is preferably illuminated when the player is in second place position during the race. At the finish of the race, this icon 164 also preferably flashes at a 50% duty-cycle.

A finish flag visual display icon 166 is used to signal the finish of a race. The finish flag icon 166 is preferably linked to the first and second place icons and also flashes at a 50% duty cycle at the end of the race on the side of the winner.

A gas icon visual display 168 in the form of a rotated gas can includes a plurality of segments 169 (e.g. four) that show the amount of fuel remaining in fuel tank. As the vehicle travels through several laps, the microcontroller calculates how much fuel is used. One by one, the fuel segments turn off, beginning at the top segment. During a pit stop for refueling, these segments turn back on, preferably one at a time, as the animated fuel enters the vehicle. Approximately half-way through the predetermined duration of the last fuel segment, the last fuel segment preferably begins flashing at a 50% duty-cycle, and after three seconds triggers the pit animation on the display 154. An audio warning that a pit stop is needed can also be played through the speaker 52. If the player does not make the necessary pit stop, power to the player's track will be turned off to force the pit stop. Preferably, the power is turned off at an appropriate moment so that when the vehicle comes to rest, it will be in the pit stop area 39. Alternatively, the vehicle can be powered at a very low duty cycle (e.g. 5% or 10%) to limp around the track to the pit area.

A gas can visual display icon 170 is preferably always illuminated and encompasses the fuel segments 169.

A tire visual display icon indicated generally at 172 has four tire segments 174 in the form of four individual tire representations that represent the tread on the tires of the vehicles. The tire segments 174 are preferably illuminated at the beginning of a race and turn off one at a time in a predetermined order. For example, the tire segments 174 may turn off in the following order: 1) top left, 2) top right, 3) bottom left, and 4) bottom right. Approximately half-way through the specified wear of the last tire, the last tire segment preferably begins to flash and after three seconds the pit animation is triggered. An audio warning can also be played through the speaker 52.

According to an exemplary embodiment of the invention, the first, second and third fuel segments 169 will have a duration of five laps, while the fourth fuel segment will have duration between 3 to 5 laps. The duration of the fourth fuel segment is preferably determined randomly by the micro-controller. Half-way through the determined duration of the fourth (last) fuel segment, it preferably begins to flash at a 50% duty-cycle.

As shown in TABLE 1 below, and by way of example, when a 10-lap race is chosen by a player, no fuel pit stop will be required. However, when a 25-lap race is selected, a pit stop for refueling must be taken between 18 and 20 laps. Likewise, when a 75-lap race is chosen, two pit stops must be taken, one between 18 and 20 laps, and the other between 36 and 40 laps. As shown, a greater number of specified laps for a race will require a greater number of pit stops for refueling.

TABLE 1

| Necessary Fuel Pit | Laps 18–20 | Laps 36–40 | Laps 72–75 | Laps 90–100 |
|---|---|---|---|---|
| 10 Lap Race | N/A | N/A | N/A | N/A |
| 25 Lap Race | X | N/A | N/A | N/A |
| 50 Lap Race | X | X | N/A | N/A |
| 75 Lap Race | X | X | X | N/A |
| 100 Lap Race | X | X | X | X |

As shown in TABLE 2 below, and by way of example, when a 10-lap or 25-lap race is chosen by a player, no tire pit stop will be required. However, when a 50-lap or 75-lap race is selected, a pit stop for "changing" the tires must be taken at the $44^{th}$ lap. Likewise, when a 100-lap race is chosen, two tire changing pit stops must be taken, one at the $44^{th}$ lap and the other at the $88^{th}$ lap. The tire changing pit stops are in addition to the fueling pit stops.

TABLE 2

| Necessary Tire Pit | Lap #44 | Lap #88 |
|---|---|---|
| 10 Lap Race | N/A | N/A |
| 25 Lap Race | N/A | N/A |
| 50 Lap Race | X | N/A |

TABLE 2-continued

| Necessary Tire Pit | Lap #44 | Lap #88 |
|---|---|---|
| 75 Lap Race | X | N/A |
| 100 Lap Race | X | X |

Figure 7A:
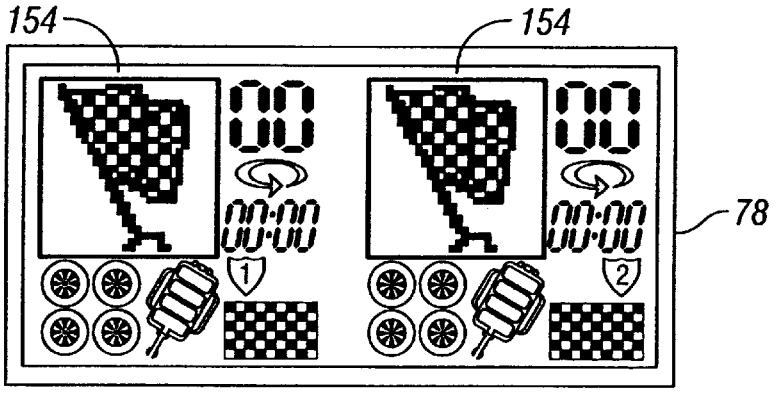
FIGS. 7A to 7C show image frames for a starting race animation sequence.
Figure 7B:
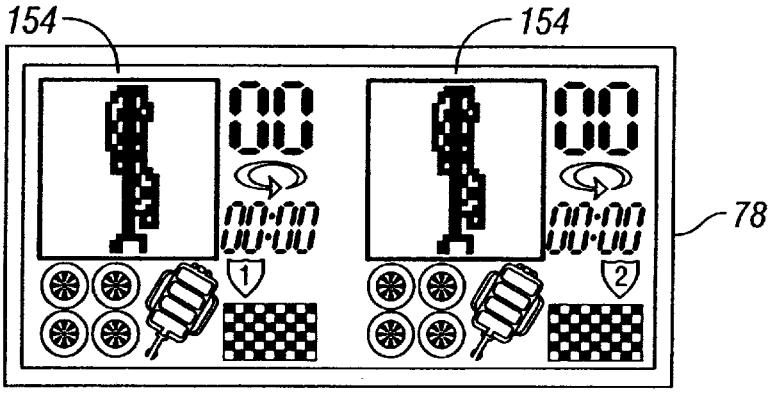
Figure 7C:
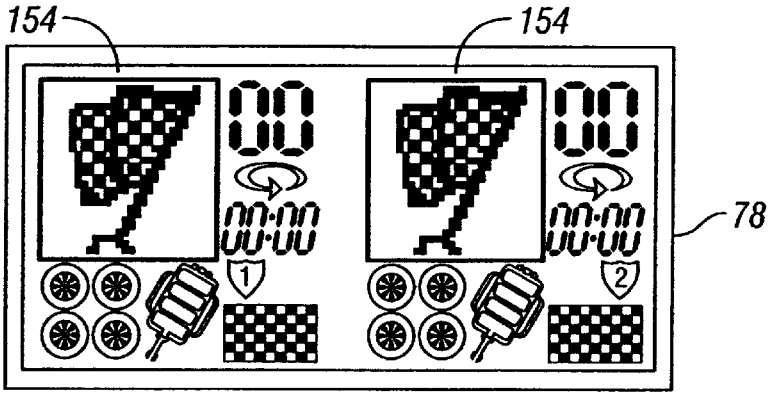

In operation, and with reference now to FIGS. 7A to 7C, the button 21 is depressed at the beginning of a race to provide power to the information and control center 10. Any time during the race, or after the race is over, the button 21 can be pressed and held to start another race. At the beginning of a new game, or after a game has been reset by depressing the button 21, a start-up animation will be displayed in the dot-matrix areas of the display panel 78. As shown, a finish flag sequence preferably loops through three animation frames (FIG. 7A, FIG. 7B, and FIG. 7C) about five times, although more or less flag loops can occur. A sound file representative of crowd noise can be played through the speaker during the flag loops.

Figure 8A:
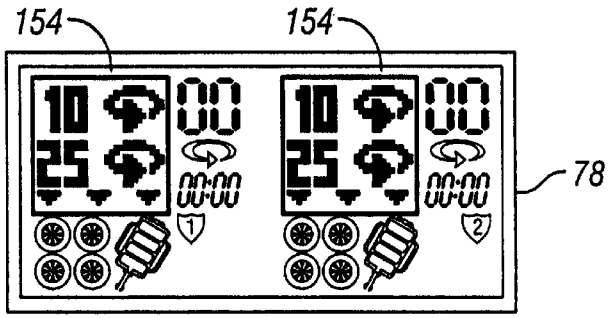
FIGS. 8A to 8E show image frames for selecting a desired number of laps.
Figure 8B:
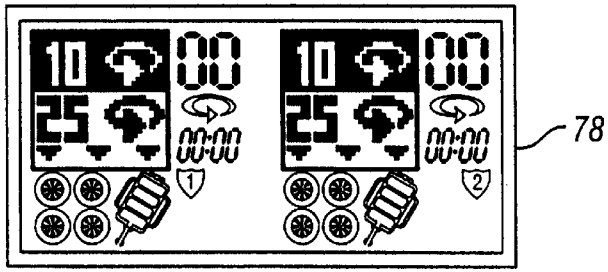
Figure 8C:
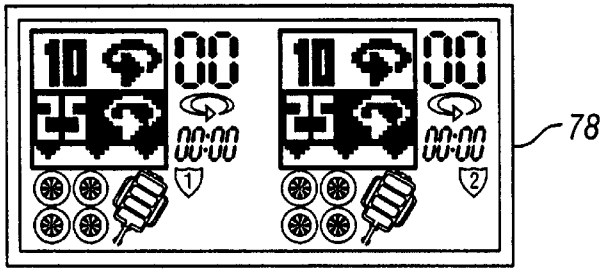
Figure 8D:
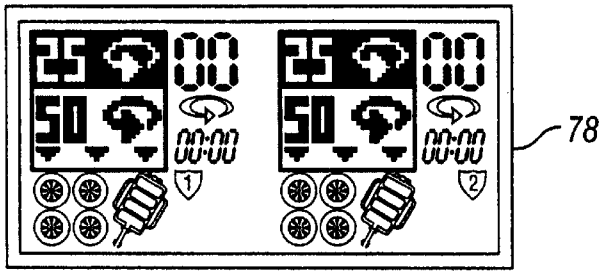
Figure 8E:
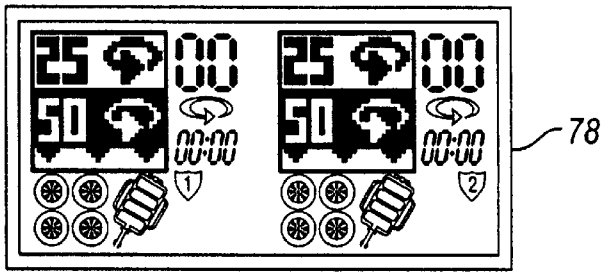

Next, and with reference now to FIGS. 8A to 8E, a lap select sequence is displayed. The player can depress the button 21 to specify the desired number of laps for a race, such as 10, 25, 50, 75, or 100 laps. One press of the button 21 sequences the display to a higher lap number. As shown in FIG. 8B, the 10- and 25-lap image is shown in the dot-matrix display with a selection bar highlighting the 10-lap image. Preferably, the selection bar flashes at a 50% duty cycle until a selection is made. The player can then depress the control button 21 for a short period (e.g. three seconds) to select the 10-lap game. If a game with more than 10 laps is desired, the button 21 can be depressed again to highlight the 25-lap image (FIG. 8C). When the button 21 is depressed again, the 25- and 50-lap image is shown with the 25-lap image highlighted (FIG. 8D). When the button 21 is depressed again, the 50-lap image will be highlighted (FIG. 8E). Preferably, the lap selection display scrolls sequentially from 10/25 laps to 25/50 laps to 50/75 laps to 75/100 laps to 100/10 laps and back to 10/25 laps in a continuous loop, as long as the button 21 is repeatedly depressed. In an alternative arrangement, the lap selection display can scroll sequentially from 10/25 to 50/75 to 100/10 and back to 10/25 in order to speed the selection of a desired lap number.

Preferably, each time the button 21 is depressed, a distinctive sound such as an engine revving sound is played through the speaker. Once a player chooses a particular lap number by holding the control button 21, another distinctive sound such as, a "peel-out" sound is preferably played through the speaker.

Figure 9A:
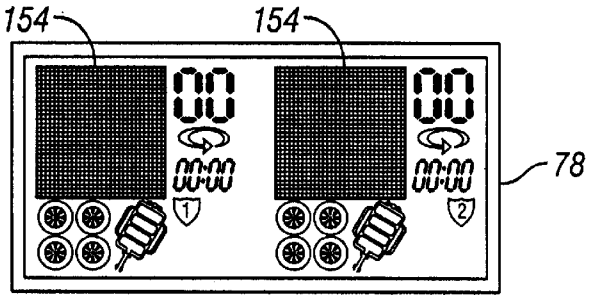
FIGS. 9A to 9F show image frames for a count down animation sequence.
Figure 9B:
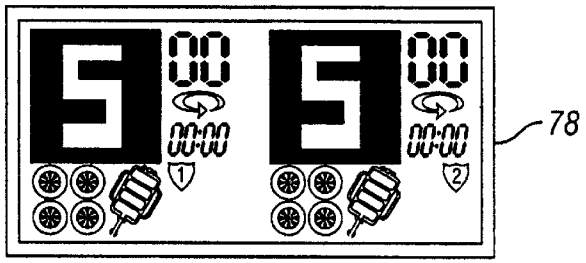
Figure 9C:
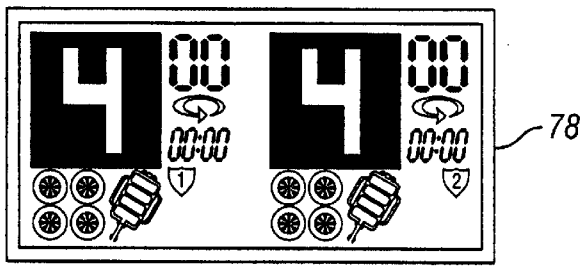
Figure 9D:
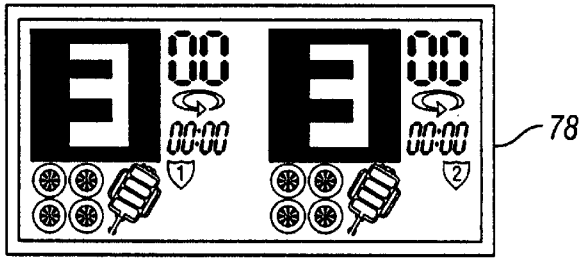
Figure 9E:
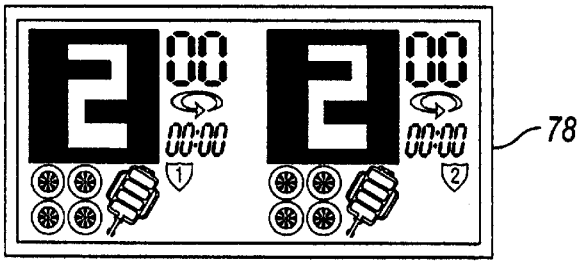
Figure 9F:
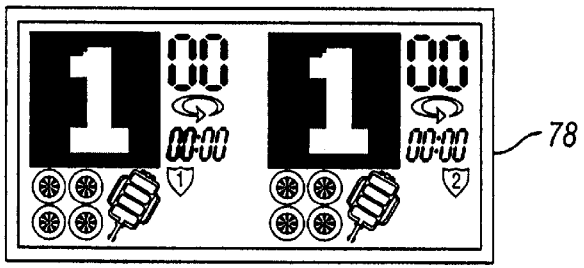

Referring now to FIGS. 9A to 9F, a series of sequential count-down frames is illustrated. Once a desired number of laps are selected, a one-second pause is initiated during which the dot-matrix display 154 turns black (FIG. 9A). During this time, the microcontroller determines whether any vehicles are properly located on the track, e.g. whether the electrical tabs on a bottom of a vehicle are in electrical contact with the rails 30 and 32. If it is determined that no vehicles are present, the display 154 remains black. Once it is determined that a vehicle is properly positioned on the track, the countdown preferably begins three seconds after the vehicle is connected. As shown in FIG. 9B, the count begins at "5" and preferably lasts one second. A beep sound can be played for each countdown frame as shown in FIGS. 9B, 9C, 9D, 9E, and 9F. An engine idle sound also preferably plays along with the beeps. Once the countdown is completed, the dot matrix display 154 preferably blanks out for approximately 0.5 second, as shown in FIG. 9A.

Figure 10A:
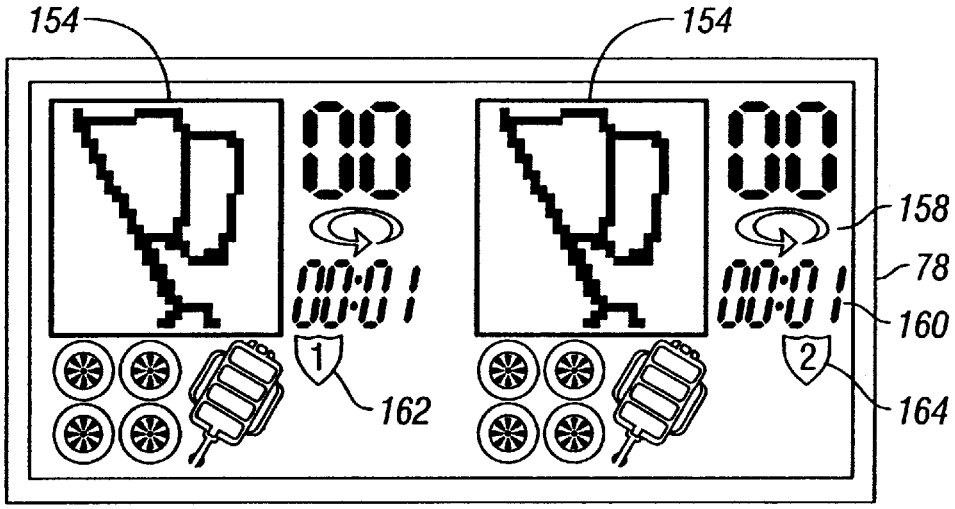
FIGS. 10A to 10C show image frames for a starting flag animation sequence.
Figure 10B:
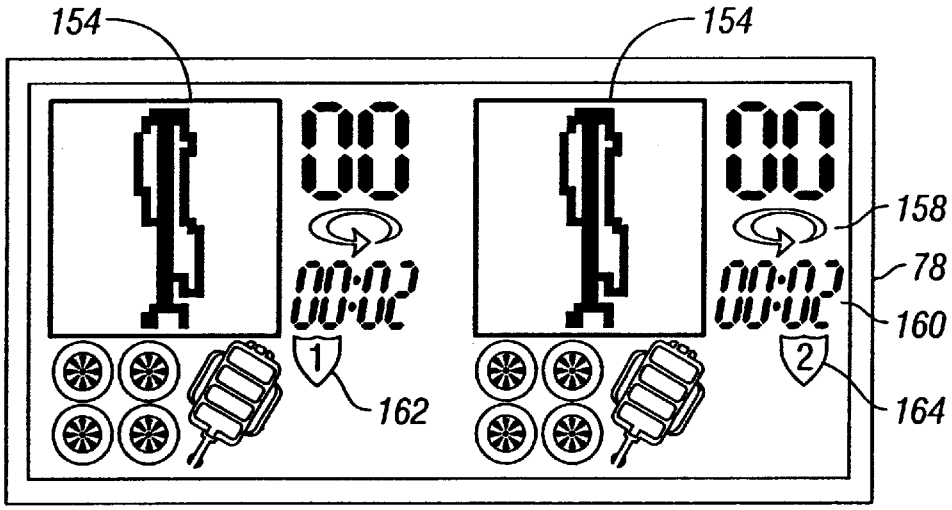
Figure 10C:
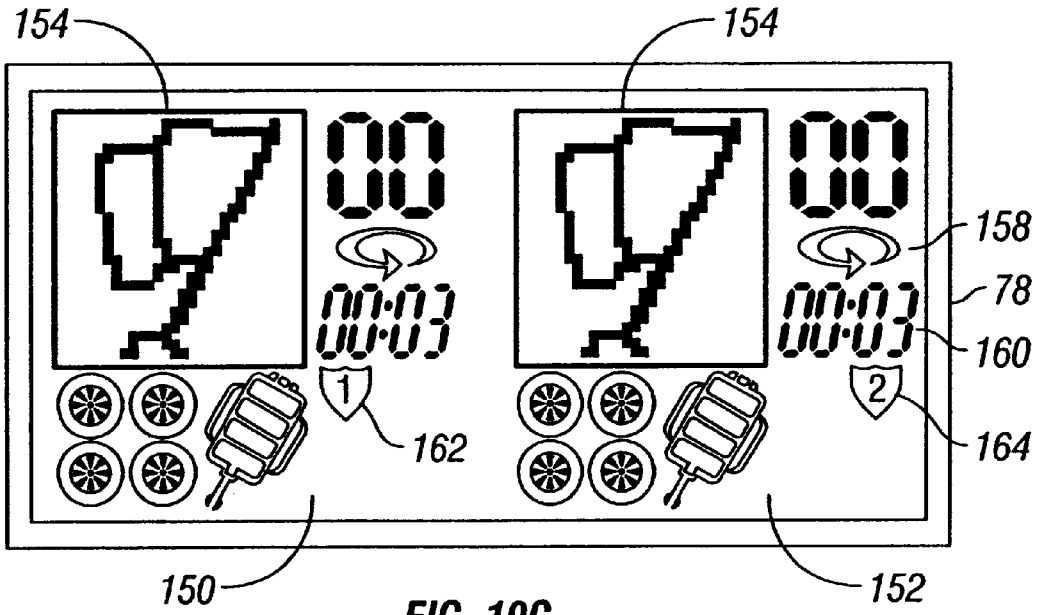

With reference now to FIGS. 10A to 10C, three sequential frames of a starting flag sequence are illustrated. In FIG. 10A, a first frame of a starting flag sequence is displayed with a flag in the right position in each dot matrix display 154. At the same time, a timer begins counting, as shown by the timer 160. A "peel-out" sound can be played in conjunction with display of the first starting flag frame. In FIG. 10B, a second starting flag frame is displayed with the flag in a center position, and the timer 160 is updated. At this point, the lap indicator icon 156 preferably begins flashing at a 50% duty cycle. In FIG. 10C, a third starting flag frame is displayed with the flag in a left position, and the timer 160 is again updated. Preferably, the starting flag rapidly sequences through the three frames for a total of three cycles. Of course, it is to be understood that more or less frames can be provided, and that the frames can sequence over more or less than three cycles. The display at this point also shows that the first place icon 162 is illuminated in the display section 150, while the second place icon 164 is illuminated in the display section 152, indicating that the vehicle associated with the display section 150 is ahead of the vehicle associated with the display section 152.

Figure 11A:
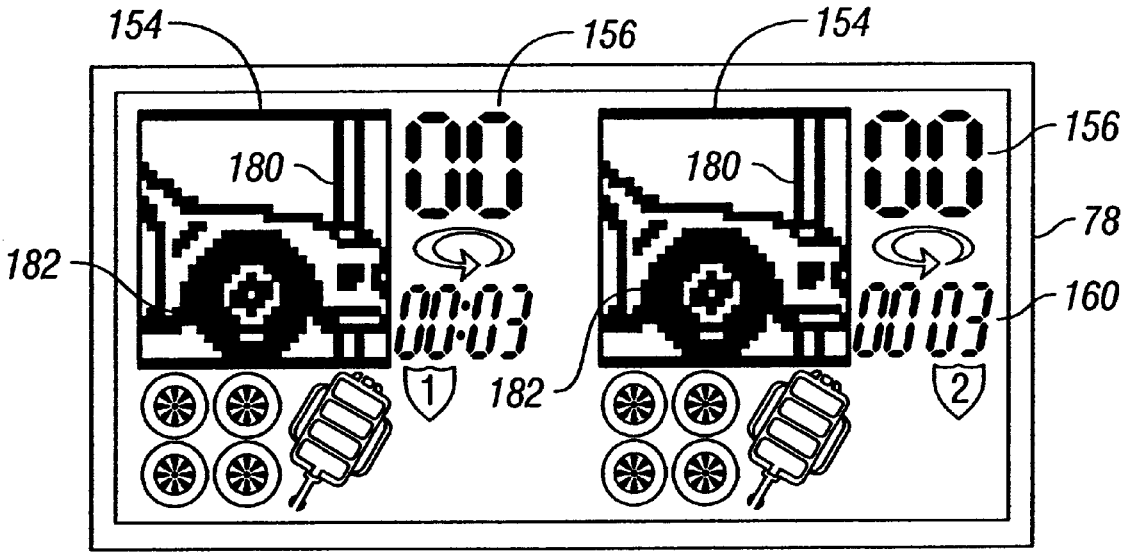
FIGS. 11A to 11C show image frames that illustrate an animation sequence for a default side view of a running vehicle.
Figure 11B:
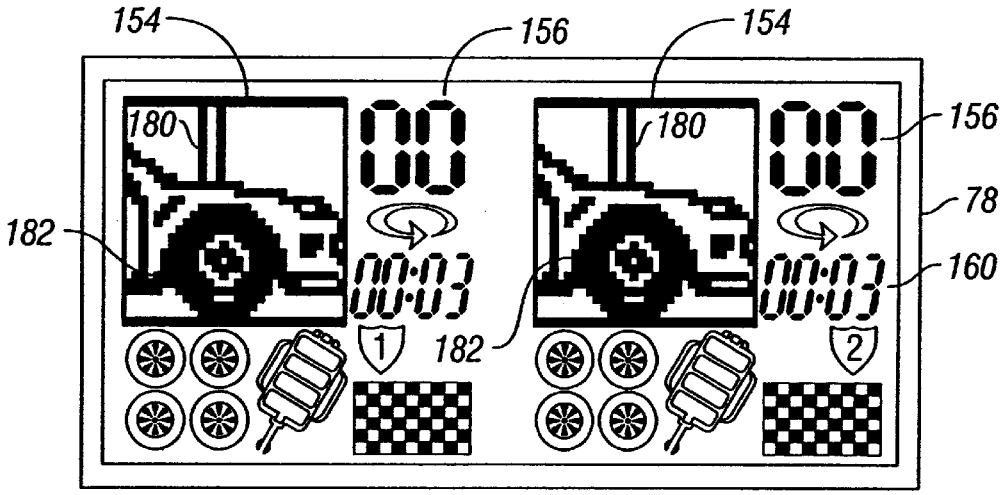
Figure 11C:
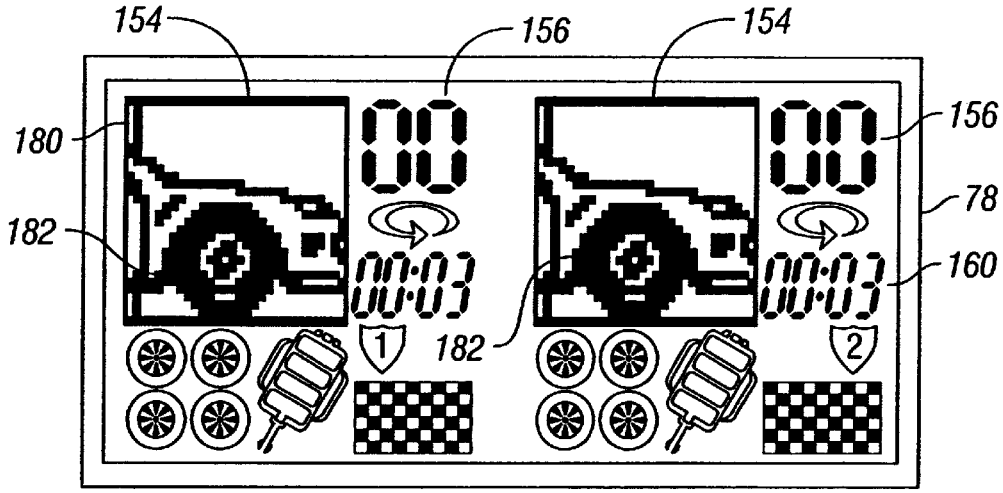

With reference now to FIGS. 11A to 11C, three sequential frames of a default side view of a traveling vehicle in the dot matrix displays 154 is illustrated. As shown in FIG. 11A, the first frame shows a vertical bar 180 and a spoke wheel 182 at a first position. In FIG. 11B, the vertical bar 180 and spoke wheel 182 are at a second position. Finally, in FIG. 11C, the vertical bar 180 and spoke wheel 182 are at a third position. The change in position of the vertical bar and spoke wheel in this manner gives the appearance that the vehicle in each display 154 is moving. These looped views are displayed in default and only when the car in questioned is being driven on the track. When the car is not moving, one of the figures, e.g. FIG. 11A, is maintained on the display as the default image. When the moving frames are displayed, a sound file is also suggestedly played and looped with the frames. In addition, the timer 160 and lap counter 156 are continuously updated for each vehicle until the player(s) pass the finish line. If desired, the tempo of the animation can be varied relative to the voltage level of the signal from the variable resistor 108 or the position of the trigger 96 (FIG. 2) of either hand control units 18 and 20 or some other source outputting a variable signal at least generally reflective of relative speed of the vehicle(s) on the track. In this way, the frames associated with one vehicle may be sequenced at a greater rate than the frames of another vehicle when the one vehicle is traveling faster than the other vehicle.

Figure 12A:
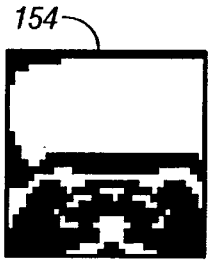
FIGS. 12A to 12C show image frames that illustrate an animation sequence for driving a vehicle as viewed from the inside of the vehicle.
Figure 12B:
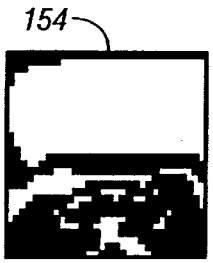
Figure 12C:
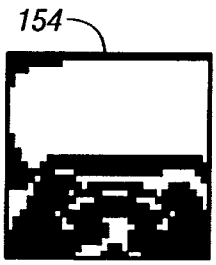

With reference now to FIGS. 12A to 12C, three sequential frames of an inside view of a vehicle for the dot matrix displays 154 are illustrated. During the course of the race, the microcontroller will specify, in a random manner, that these frames be substituted for the default side view frames of FIGS. 11A to 11C. Preferably, the frames loop rapidly between the FIG. 12A, FIG. 12B and FIG. 12C frames to simulate movement of a driver's hands on a steering wheel (FIG. 12A straight, 12B left turn, 12C right turn). This sequence is also preferably used in conjunction with the default pit view sequence as a lead-in animation.

Figure 13A:
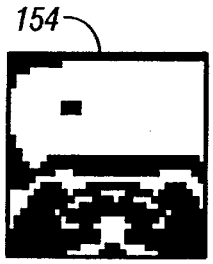
FIGS. 13A to 13C show image frames that illustrate an animation sequence for approaching a pit stop as viewed from the inside of a vehicle.
Figure 13B:
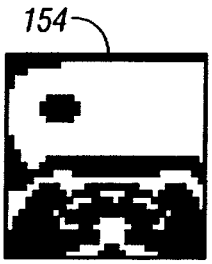
Figure 13C:
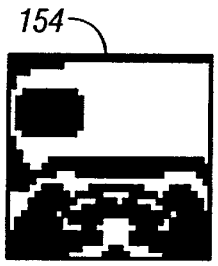

With reference now to FIGS. 13A to 13C, three sequential frames of an inside view of a vehicle approaching the pit stop area are illustrated. This sequence is shared with the fuel pit and tire pit animations, as will be described in greater detail below. This sequence is preferably used in conjunction with the default inside view (FIGS. 12A–12C) and the appropriate pit animation. During this animation, an audio warning of low fuel or worn tires can be played.

Figure 14A:
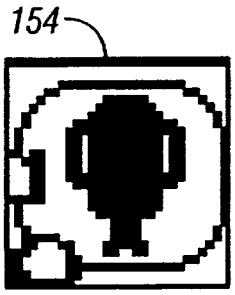
FIGS. 14A to 14N show image frames that illustrate an animation sequence for a fuel pit stop.
Figure 14B:
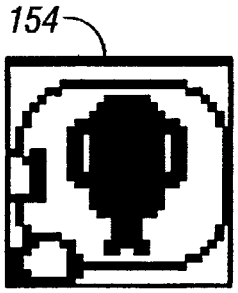
Figure 14C:
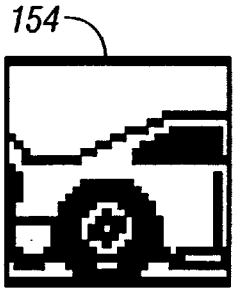
Figure 14D:
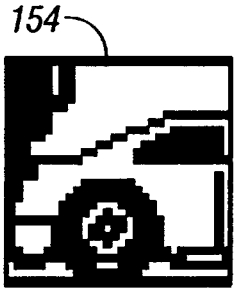
Figure 14E:
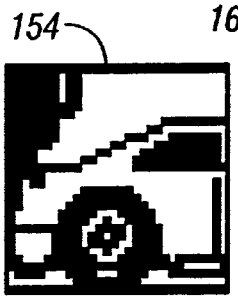
Figure 14F:
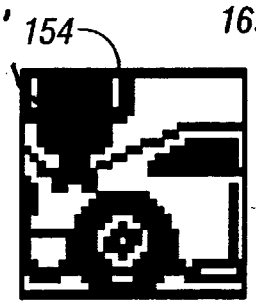
Figure 14G:
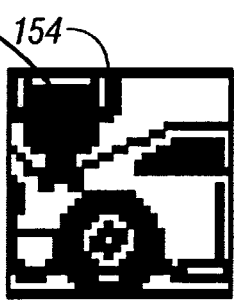
Figure 14H:
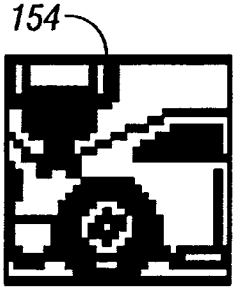
Figure 14I:
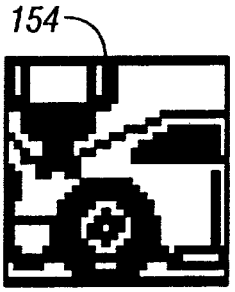
Figure 14J:
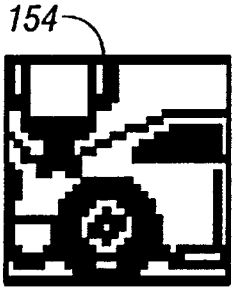
Figure 14K:
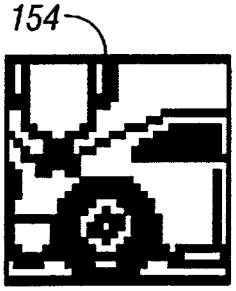
Figure 14L:
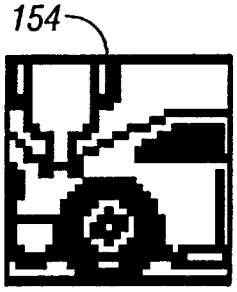
Figure 14M:
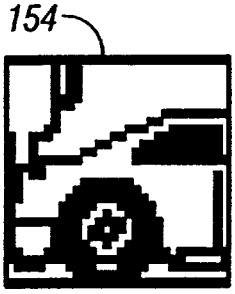
Figure 14N:
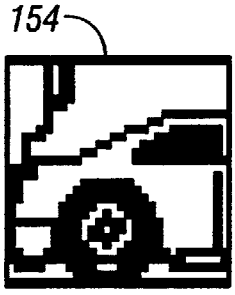
Figure 16A:
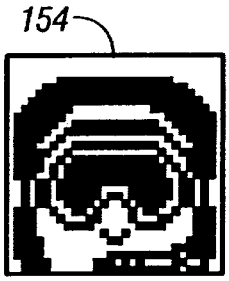
FIGS. 16A to 16L show image frames that illustrate an animation sequence for a vehicle crash.
Figure 16B:
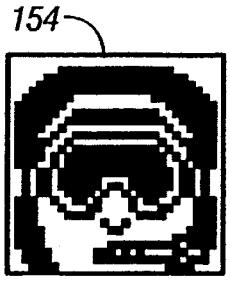
Figure 16C:
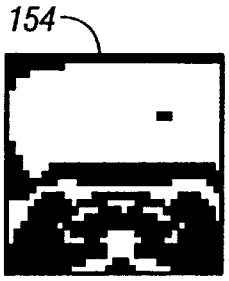
Figure 16D:
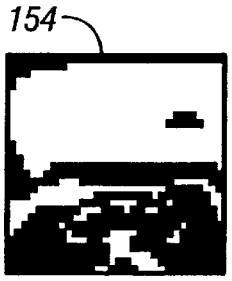
Figure 16E:
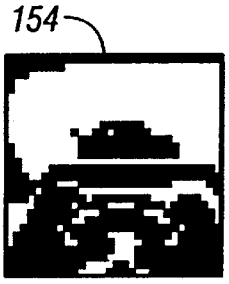
Figure 16F:
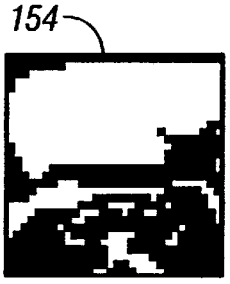
Figure 16G:
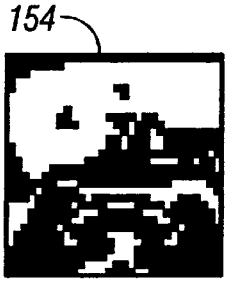
Figure 16H:
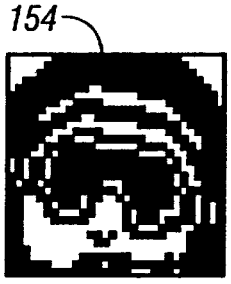
Figure 16I:
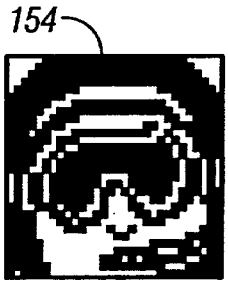
Figure 16J:
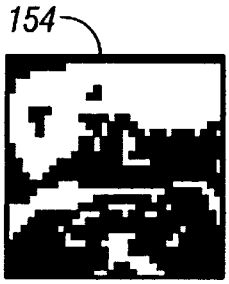
Figure 16K:
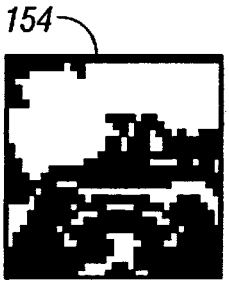
Figure 16L:
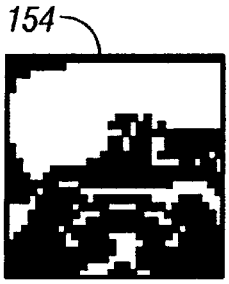

With reference now to FIGS. 14A to 14N, fourteen sequential frames of a fuel pit animation for the dot matrix display 154 are illustrated. When the vehicle is halfway through its last fuel segment 169 (FIG. 6), a pit stop will be necessary. The player's power to the track is preferably cut off while the vehicle is in the pit stop area 39. The player will be playing the part of the pit-crew by manipulation of the control button 98 (FIG. 1) on the hand control unit 18 or 20 to advance the re-fueling animation, e.g. bringing the fuel can on screen (FIGS. 14A through 14F). As soon as the player presses the control button 98 five times, the animated tank will drain one segment (FIG. 14G) while the segmented fuel tank 168 (FIG. 6) increases by one segment. For a total of four segments, as shown in FIG. 6, the player must press the control button a total of twenty times before the animated fuel can is empty and all the fuel segments 169 are full (FIGS. 14G through 14L). Of course, it is to be understood that more or less fuel segments can be provided, as well as the number of times the control button 98 must be pressed to "fill" a segment. The animated fuel can is then removed (FIGS. 14M and 14N). During the pit stop, the timer 160 continues to count. Although the lap indicator will not change during the pit stop, it will continue to flash. The engine idle sound can be played during the pit stop, and the peel-out sound can be played when the vehicle takes off again. Preferably, the power to the player's track will remain off until the control button 98 has been depressed the required number of times.

Figure 15A:
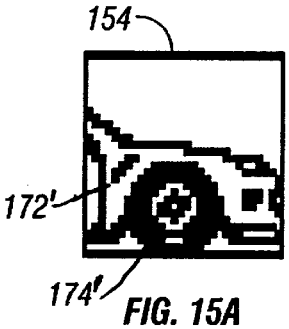
FIGS. 15A to 15D show image frames that illustrate an animation sequence for a tire pit stop.
Figure 15B:
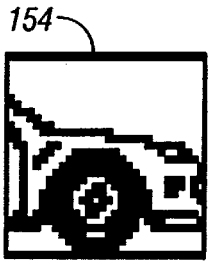
Figure 15C:
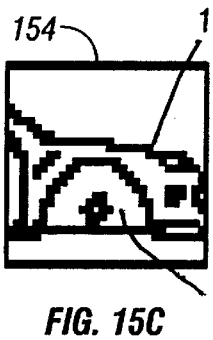
Figure 15D:
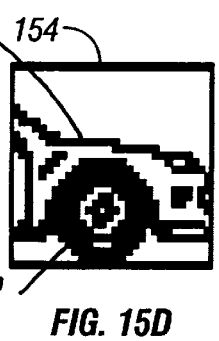

With reference now to FIGS. 15A to 15D, four sequential frames of a tire pit animation for the dot matrix display 154 are illustrated. When the vehicle is halfway through its last tire segment 174 (FIG. 6), a pit stop will be necessary on the next lap. The player's power to the track is preferably cut off while the vehicle is in the pit stop area 39. In FIG. 15A, the vehicle is shown in a lowered position, indicating that the tires are worn. In FIG. 15B, the vehicle is shown in a raised position. In FIG. 15C, the vehicle is shown in a raised position with the wheel removed. In FIG. 15D, the vehicle is shown in a normal operating position. In order to change each wheel, the player must press the control button 98 five times. A first new tire then appears on the dot matrix display 154 (FIG. 15D) and on the segmented tire area 172. Preferably, the animation is suspended at the FIG. 15C frame while the additional tires are being installed. The player is able to tell how may tires have been changed by watching the tire segments 174 illuminate one-by-one in the tire area 172. When the tire changes are complete, the above animation sequence preferably reverses order. During the tire pit stop, the timer 160 continues to count. Although the lap indicator will not change during the tire pit stop, it will continue to flash. The engine idle sound can be played during the pit stop, and the peel-out sound can be played when the vehicle takes off again. Preferably, the power to the player's track will remain off until the control button 98 has been depressed the required number of times to change all four tires.

Figure 17A:
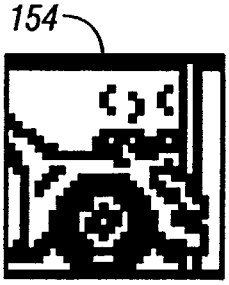
FIGS. 17A to 17B show image frames that illustrate a side view animation sequence for a vehicle crash.
Figure 17B:
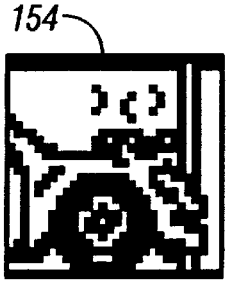
Figure 18A:
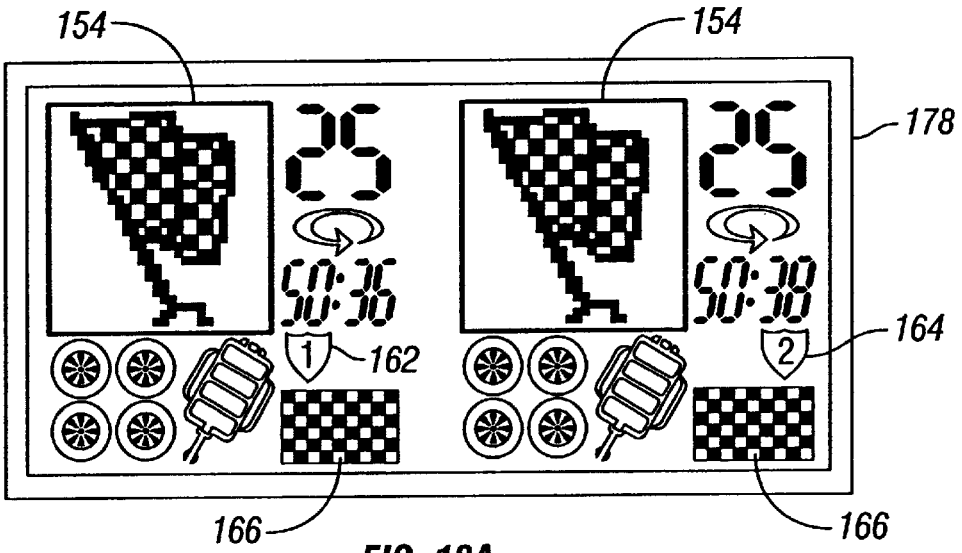
FIGS. 18A to 18D show image frames for a finish flag animation sequence.
Figure 18B:
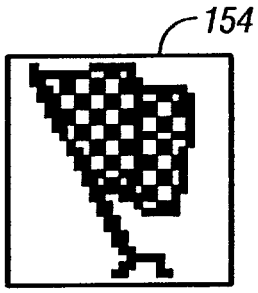
Figure 18C:
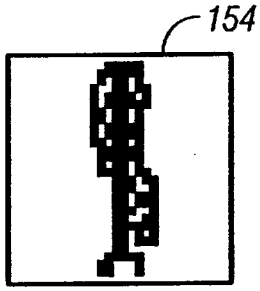
Figure 18D:
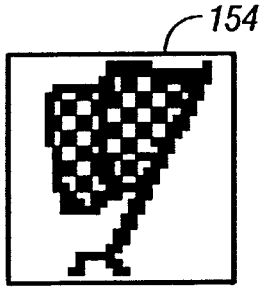

With reference now to FIGS. 16A to 16L and FIGS. 17A and 17B, sequential frames of a crash animation for the dot matrix display 154 are illustrated. If at any time the processor determines that a crash has occurred (by sensing that a vehicle has left contact with the track with the trigger 96 depressed, as previously described), the frames 16A through 16L showing the driver's face and the inside of the vehicle are preferably displayed in sequence. The frames showing the side view of a crash (FIGS. 17A and 17B) are also displayed in sequence. A crashing sound can be played during the initial sequence (FIGS. 16A to 16L) and an engine idle sound can be played during the side view crash sequence (FIGS. 17A and 17B). Once the car is put back on the track, the animation preferably switches to the default side view frames (FIGS. 11A to 11C). During the crash, the timer 160 continues to count and the lap indicator continues to flash, although it will not increase in value.

With reference now to FIGS. 18A to 18D, sequential frames of a finish flag for the dot matrix display 154 are illustrated. Once the player has completed his final lap by crossing the finish line (isolated area 37 in FIG. 1), the finish flag animation will begin across the winner's display 154. Power can still be supplied to both tracks, but each timer 160 can be stopped when its associated vehicle crosses the finish line. Alternatively, power can be cut to the tracks when the winner completes the final lap or when the second player completes the lap he is in after the winner completes his final lap. Alternatively the winner can be given a winner's lap under the user's control or at partial power and slower speed. Other termination options are possible. Preferably, the frames 18B to 18D are sequentially cycled for several (e.g. three) times. The final position 162 or 164 of the vehicle can also flash on its associated display 154 along with the checkered flag icon 166. The crowd sound can also be played simultaneously.

Figure 19A:
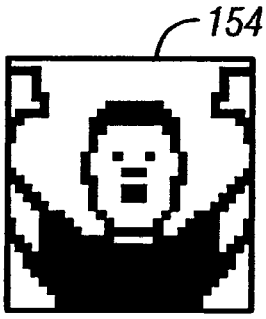
FIGS. 19A and 19B show image frames for a crowd movement animation sequence.
Figure 19B:
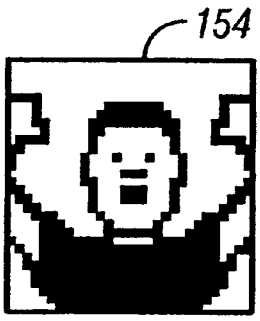

As shown in FIGS. 19A and 19B, two frames of a crowd animation are illustrated. After the finish flag animation stops, the crowd loop animation can begin. The two frames illustrated in FIGS. 19A and 19B preferably loop for about 5–6 seconds. The crowd sound can continue to play with the crowd animation.

Figure 20:
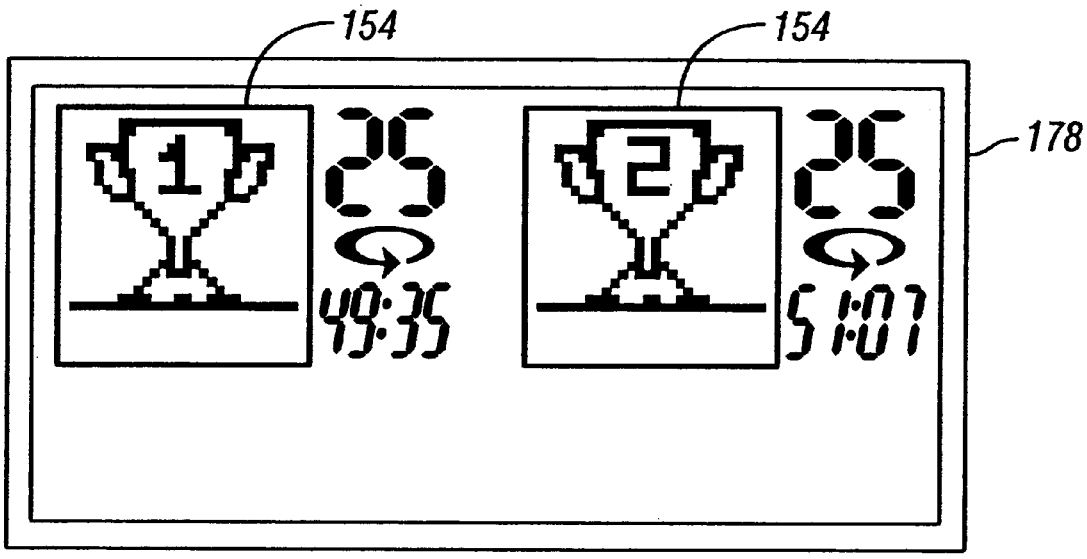
FIG. 20 shows an image frame for the end of the race with position of finish and time.

Suggestedly, after the crowd sequence stops, a display image as shown in FIG. 20 can be generated in the dot matrix displays 154. The fastest lap time and total elapse time can be alternately displayed for each driver. The sequence preferably begins with an engine revving sound and then finishes with the crowd sound. After the display sequence, the game loops back to the lap selection sequence (FIGS. 8A to 8E). The game can then loop back to the lap selection sequence.

U.S. Provisional Application No. 60/267,217 filed Feb. 7, 2001, is incorporated by reference herein.

It will be appreciated by those skilled in the art that changes could be made to the embodiments described above without departing from the broad inventive concept thereof. By way of example, although the above-described functions are preferably accomplished through use of a processor, such as a microprocessor, it will be understood that other processing means can be used, such as a programmable logic device, digital circuitry, analog circuitry, or combinations thereof. It will be understood, therefore, that this invention is not limited to the particular embodiments disclosed, but it is intended to cover modifications within the spirit and scope of the present invention as defined by the appended claims.

We claim:

1. In a system including an electrically powered toy vehicle and a continuous loop track for racing the electrically powered toy vehicle under operator control, the continuous track having at least one lane and an electrical path extending along the lane for providing electrical power to the vehicle about the track, a combination comprising:

a pit stop segment in the at least one lane;

a control unit operably connected with the electrical path, the control unit including a control mechanism manually operable to electronically perform at least one simulated pit stop function on an electrically powered toy vehicle while in the pit stop segment; and an electrically operated display unit operably connected with the control unit and configured to generate a visual display of a progression of the at least one simulated pit stop function in response to manipulation of the control mechanism.

2. A system according to claim 1 wherein the simulated pit stop function comprises at least one of a simulated fuel tank refill and a simulated tire change, and the visual display comprises at least one of a fuel tank icon and a tire change icon that changes at least in response to manipulation of the control mechanism.

3. A system according to claim 2 wherein the at least one icon comprises a plurality of segments that sequentially change from a first display condition to at least a second display condition in response to manipulation of the control mechanism to thereby indicate a progression of the simulated pit stop function.

4. A system according to claim 3 wherein the control mechanism includes a push-button switch and wherein each segment changes in response to a predetermined number of manipulations of the push-button switch.

5. A system according to claim 4 further comprising processing means operably coupled between the control unit and the display unit for sequentially changing the plurality of segments in response to manipulations of the control mechanism.

6. A system according to claim 5 wherein the processing means comprises a microcontroller configured to receive signals from the push-button switch and to control the display unit to generate the plurality of segments in response to the signals.

7. A system according to claim 5 and further comprising at least one of a pit entry switch and a pit exit switch located at least proximally the pit stop segment and operably connected to the processing means for determining completion of a lap of the toy vehicle.

8. A system according to claim 7 wherein the processing means determines, from the at least one pit entry and exit switches, a number of laps completed by the toy vehicle and, based on the number of laps, sequentially changes at least one of the plurality of segments from the second display condition to the first display condition to thereby indicate at least one of depleting fuel and tire wear.

9. A system according to claim 5 further comprising a pit entry switch connected to the processing means for determining completion of a lap of the toy vehicle.

10. In a system including an electrically powered toy vehicle and a continuous loop track for racing the electrically powered toy vehicle under operator control, the continuous track having at least one lane and an electrical path extending along the lane for providing electrical power to the vehicle about the track, a combination comprising:

a pit stop segment in the at least one lane;

a control unit operably connected with the electrical path, the control unit including a control mechanism manually operable to electronically perform at least one simulated pit stop function on an electrically powered toy vehicle while in the pit stop segment;

an electrically operated display unit operably connected with the control unit and configured to generate a visual display of a progression of the at least one simulated pit stop function in response to manipulation of the control mechanism; wherein:

the simulated pit stop function comprises at least one of a simulated fuel tank refill and a simulated tire change, and the visual display comprises at least one of a fuel tank icon and a tire change icon that changes at least in response to manipulation of the control mechanism;

the at least one icon comprises a plurality of segments that sequentially change from a first display condition to at least a second display condition in response to manipulation of the control mechanism to thereby indicate a progression of the simulated pit stop function;

the control mechanism includes a push-button switch and each segment changes in response to a predetermined number of manipulations of the push-button switch; and further comprising processing means operably coupled between the control unit and the display unit for sequentially changing the plurality of segments in response to manipulations of the control mechanism;

a pit entry switch connected to the processing means for determining completion of a lap of the toy vehicle; and a pit exit switch spaced from the pit entry switch, and wherein:

the processing means determines that the toy vehicle is stopped in the pit stop segment when the pit exit switch fails to activate within a predetermined time period after activation of the pit entry switch.

11. A system according to claim 1 further comprising processing means operably coupling the control unit with the display unit for changing the visual display of the display unit upon manipulation of the control mechanism.

12. A system according to claim 11 wherein the visual display comprises at least one pit stop icon with a plurality of segments that sequentially change from a first display condition to at least a second display condition in response to manipulation of the control mechanism to thereby indicate a progression of the pit stop function.

13. A system according to claim 12 further comprising at least one of a pit entry switch and a pit exit switch connected to the processing means for determining completion of a lap of the toy vehicle.

14. A system according to claim 13 wherein the processing means determines, from the at least one pit entry and exit switches, a number of laps completed by the toy vehicle and, based on the number of laps, sequentially changes at least one of the plurality of segments from the second display condition to the first display condition to thereby indicate at least one of depleting fuel and tire wear.

15. A system according to claim 14 further comprising a remaining one of the pit entry switch and the pit exit switch, the pit exit switch being spaced from the pit entry switch, and wherein the processing means determines that the toy vehicle is stopped in the pit stop segment when the pit exit switch fails to activate within a predetermined time period after activation of the pit entry switch.

16. A system according to claim 12 wherein the control mechanism is a push-button switch, and further wherein the processing means sequentially changes the plurality of segments in response to plural manipulations of the push-button switch.

17. A system according to claim 16 wherein the processing means is responsive to plural manipulations of the push-button switch to change one of the segments.

18. A system according to claim 17 wherein the processing means comprises a microcontroller coupled with the control unit to receive signals upon actuation of the push button switch and to the display unit to control the plurality of segments of the visual display in response to the signals.

19. A system according to claim 1 wherein the control unit has at least a portion shaped as a hand grip.

20. A system according to claim 1 wherein the control unit includes another control mechanism manually operable to vary speed of the toy vehicle on the continuous track.

21. A system according to claim 1 further comprising processing means for determining when the vehicle has left the track and updating the display in response thereto.

22. A system according to claim 20 wherein the two control mechanisms are incorporated into a single hand control unit configured to be grasped and held.

23. A system according to claim 22 wherein each of the two control mechanisms are separate from one another on the hand control unit.

24. A system according to claim 1 wherein the control mechanism is incorporated into a hand control unit configured to be grasped and held.

25. A system according to claim 24 wherein the hand control unit includes a second control mechanism separate from the first control mechanism and manually operable to vary the speed of the toy vehicle.

* * * * *